United States Patent [19]

Hill, Jr.

[11] 3,987,615

[45] Oct. 26, 1976

[54] PROCESS OF FORMING YARNS FROM GIN MOTES

[75] Inventor: Alton V. Hill, Jr., Charlotte, N.C.

[73] Assignee: Hal Franklin Whisnant, Charlotte, N.C. ; a part interest

[22] Filed: Aug. 18, 1975

[21] Appl. No.: 605,261

[52] U.S. Cl. ..... 57/156; 19/65 R; 57/58.95

[51] Int. Cl.[2] ..... D02G 3/00

[58] Field of Search ..... 19/65 R, 65 A, 106 R; 28/72.14; 57/156, 58.95

[56] References Cited

UNITED STATES PATENTS

| | | | |
|---|---|---|---|
| 811,896 | 2/1906 | Allen | 19/65 R |
| 1,889,615 | 11/1932 | Schorsch | 19/65 R |
| 3,003,195 | 10/1961 | Varga | 19/106 R X |
| 3,107,412 | 10/1963 | Hall et al. | 28/72.14 |

OTHER PUBLICATIONS

Textile Worlds Cotton Flow Chart – p. 101, Jan., 1947.

Cotton Flow Chart – p. 1, Drawing Frames by Willis & Moore, copyright 1937.

*Primary Examiner*—Dorsey Newton

*Attorney, Agent, or Firm*—Bell, Seltzer, Park & Gibson

[57] ABSTRACT

A method of processing relatively inexpensive gin motes to reclaim the spinnable but normally waste cotton fibers contained therein and form a reduced cost yarn therefrom. The method involves cleaning the gin motes to separate and remove from the cotton fibers of the gin motes, the substantial portion of trash mixed therewith, and thereafter carding and drafting to separate and remove further amounts of trash therefrom. Subsequently, the thus processed cotton fibers of the gin motes are advanced through a combing machine and combed while additional trash is separated and removed and while short non-spinnable fibers are also removed to reduce the coefficient of variation in fiber length to a level suitable for subsequent processing into yarns. The resultant reclaimed spinnable fibers may be further processed by conventional methods, either directly from the comber to open-end or ring spinning, or indirectly by baling and later processing, alone or in blends with other fibers, to form yarns.

4 Claims, 4 Drawing Figures

PROCESS OF FORMING YARNS FROM GIN MOTES

This invention relates to the preparation of low cost cotton fibers suitable for spinning into yarns on ring or open-end spinning frames. More particularly, this invention relates to a method whereby quality yarns may be spun at a fraction of the cost of conventional yarns by the utilization of inexpensive gin motes as the fiber source material.

As is well known, gin motes are produced as the waste product of cotton gins and contain cotton fiber, trash, undeveloped cotton seeds, broken bolls, leaf, dust, dirt. Prior to the widespread use of machines for picking cotton, when it was common practice to pick cotton by hand, the cotton arriving at the gin was relatively free from trash. However, machine-picked cotton contains a comparatively larger amount of trash, stems, leaves, broken bolls, etc. Thus, the cotton gins in use today for processing machine-picked cotton are designed to remove considerably more trash than in the past. However, this also results in the removal of a larger proportion of valuable fibers along with the trash. The percentage of cotton fiber in today's gin motes may normally range from approximately 55% to about 70%. However, the cotton fibers contained in the gin motes vary significantly in length and range from extremely short non-spinnable linter fibers to conventional cotton staple lengths.

While gin motes have been employed to some extent in the production of nonwoven battings and in the production of very coarse yarns such as mop yarns (which generally fall within the range of about 0.5 to about 2 cotton count), because of the high variation in fiber length (coefficient of variation) and the presence of a substantial proportion of short non-spinnable fibers, as well as the large amount of trash, gin motes have little commercial value. Thus, gin motes are normally regarded as waste and disposed of by the cotton gins. Because of increasingly stringent government pollution standards, the cotton gins are being forced to stop burning gin motes as has been the conventional practice. Thus, uncleaned or raw gin motes are available in increasingly large quantities from the cotton gins at a very low cost.

Accordingly, it is a primary object of the present invention to provide a method for processing this very inexpensive gin motes to reclaim the usable cotton fibers contained therein for forming yarns at a very low cost.

In order to process gin motes into spun cotton yarn in accordance with this invention it is first necessary to separate and remove from the cotton fiber of the gin motes the high percentage of trash, leaf, dirt dust, etc., contained therein. Since the cotton fibers contained in the gin motes have an extreme variation in staple length as noted above (approximately 45% to 60% coefficient of variation (CV) as compared to a CV of about 30% to 32% for normal cotton) it is also necessary to reduce the coefficient of variation of the fibers to an acceptable range.

Due to the inherent design of cotton spinning and spinning preparatory machinery, only fibers with a low coefficient of variation can be spun into an even, universally accepted yarn. As the coefficient of variation increases, yarn uneveness also increases. Yarn spun from cotton fibers with a high coefficient of variation such as contained in gin motes, if spinnable at all, will be lumpy, uneven, and have extreme thick and thin places, making it unsuitable for most purposes.

Thus, the present invention has as an object the reduction of the coefficient of variation of the fibers of the gin motes to an acceptable level. This CV reduction is accomplished by passing gin motes, after first being cleaned, carded and drafted, through a cotton comber and extracting the short non-spinnable fibers. Most of the trash remaining in the cotton fibers at this time is also removed by the comber.

The combing machine was designed for and has always been associated with medium to long staple cotton to be spun into high quality fine count, lustrous, relatively expensive combed cotton yarns to be knitted or woven into high quality cloth. Combers have never been associated with or recognized as useful for processing gin motes. While the comber noil from combing conventional staple length cotton contains a substantial proportion of long fibers and is thus usable for some purposes such as very low quality or coarse yarns, the noil from combing gin motes is entirely different. The noil consists almost entirely of extremely short fibers and pepper trash and contains hardly any recognizable spinnable fibers.

Following combing, the reclaimed spinnable fibers from the gin motes can be handled in various ways. For example, the combed and cleaned stock from the combing machine could be baled. In this instance it may be advantageous to install the mote cleaning, carding, pre-comber drafting and combing unit at or near the site of the cotton gins. The baled, cleaned and carded reclaimed fibers could then be shipped to mills for spinning into yarns either alone or in blends with other conventional natural or synthetic fibers.

Alternatively, the comber sliver could be processed directly from the comber through one or more further drawing operations, including blending with other conventional fibers if desired, and then either through roving and to a ring spinning frame or directly to an open-end spinning machine. The high degree of parallelization of the fibers by the comber is advantageous especially in open-end spinning to eliminate or reduce the occurrence of hooked fibers, which, as is well known, is a significant problem in open-end spinning and undesirably affects the quality and strength of the yarns being produced.

Some of the objects and features of the invention having been set forth, others will appear as the detailed description of the preferred embodiment of the invention proceeds, when taken in connection with the accompanying drawings, in which FIG. 1 is a block diagram illustrating the various steps according to the method of this invention;

Figure 1:
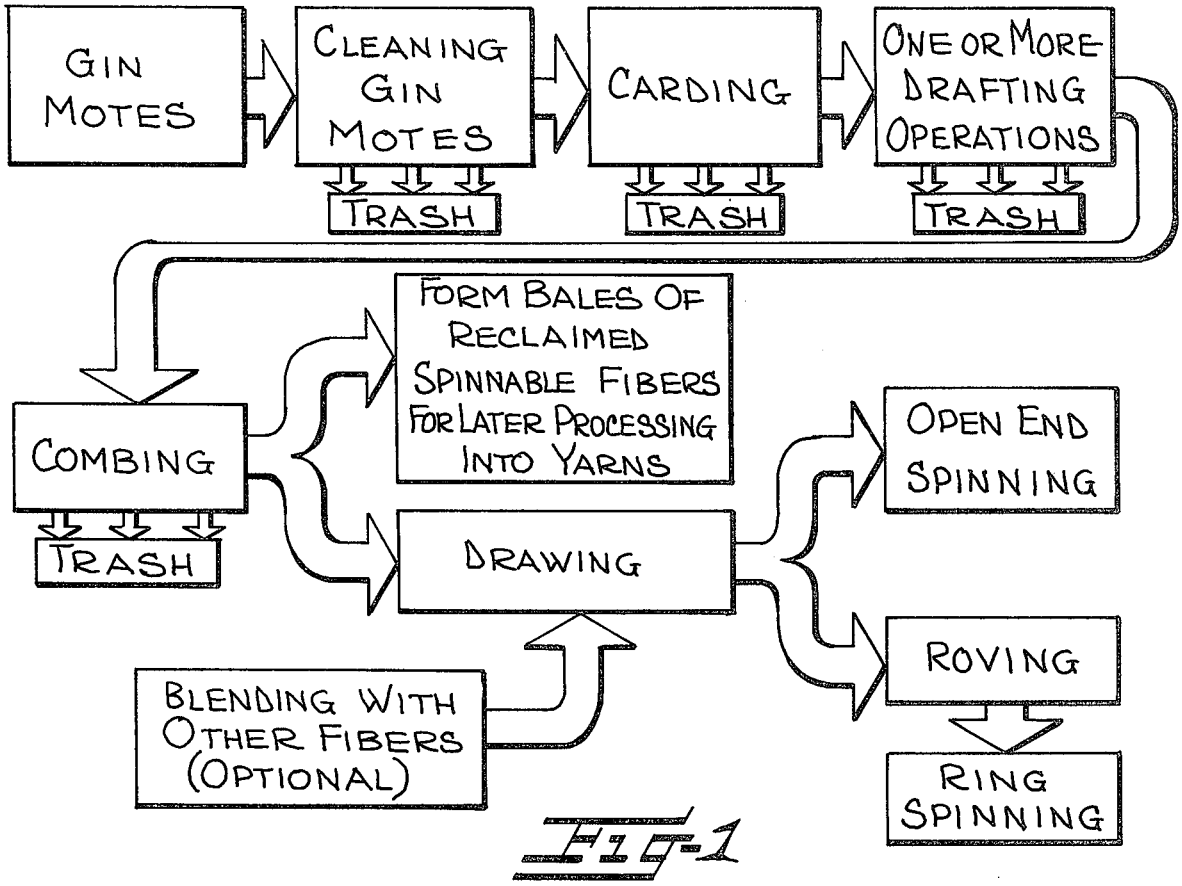

Referring now to the drawings, there is shown in FIG. 1 a block diagram of the successive method steps in accordance with this invention. Gin motes, which is the waste product from the cotton gin and consists of cotton fiber and trash, including leaf, broken boll, broken twig, undeveloped seed, pieces of developed seed, sand, dust or dirt, is initially subjected to cleaning operations to separate and remove from the cotton fiber, a substantial portion of the foreign matter or trash. These cleaning operations comprise passing the gin motes through a cleaning line consisting of one or preferably a series of conventional cotton cleaning and/or opening machines.

Primarily, the cleaning line is concerned with removing heavier trash and undeveloped seeds, although a significant portion of the smaller and lighter trash may also be removed in the cleaning line as well. It is important to remove the undeveloped seeds since they contain oil and can cause trouble later in the processing, as for example on the card crush rolls.

Normally, about 35% to 50% by weight of waste will be extracted by the cleaning line. Of course, since cleaning machines are not 100% efficient, certain amounts of usable fibers are carried away as waste along with the removed trash, thus reducing the ultimate percentage yield of reclaimable fibers. Because of this high percentage of trash removal, which is much higher than would be obtained from processing normal cotton through a cleaning line, automatic waste removal from the cleaning line is advisable.

Gin motes may be purchased either in raw or uncleaned form, or in pre-cleaned form, usually baled. In order to save on freight charges, it is preferable to subject raw gin motes to at least a preliminary cleaning operation at or near the gin site, even though further cleaning is normally necessary later at the mill.

Just as the quality of cotton varies according to differing soil and climatic conditions, as well as on account of other factors, so the quality of gin motes vary greatly. This variation depends also upon the type of lint cleaners in the gin, how they are set, and the gin operators. Some gins may extract 1.5% motes and others 3% motes on the same cotton. Naturally it is important to have a uniform end product for spinning. This uniformity is best achieved by mixing or blending a wide cross section of gin motes from different sources, etc. during the cleaning operations. It is possible, however, to go direct from the gin mote cleaning line to pickers or direct feed cards.

Following cleaning, the gin motes are next processed through conventional cotton carding machines, which serve to open up the cotton fibers more completely and to further clean the cotton of accompanying foreign matter or trash.

Naturally, if the gin motes are received at the mill in bale form, having already been initially cleaned, it will be necessary prior to carding to process the gin motes through conventional opening operations. This opening of the pre-cleaned gin motes may be viewed merely as a further part of the cleaning operation preparatory to carding.

Preferably, the cards should be equipped with crush rolls to facilitate in further removing trash from the cotton fibers of the gin motes. Because of the relatively high proportion of trash removed by the cards, it is also preferable to equip the cards with suction cleaning, especially under the licker-in.

Following carding, as is illustrated in the block diagram of FIG. 1, the cleaned and carded cotton stock is processed through one or more drafting operations preparatory to combing. The purpose of these drafting operations is to straighten or orient the fibers contained in the card sliver in preparation for combing. These drafting operations are normally performed while also forming the card sliver into a lap suitable for feeding to the comber, as for example by processing the card sliver through a lapper or lappers, such as a sliver lapper and/or ribbon lapper.

Figure 2:
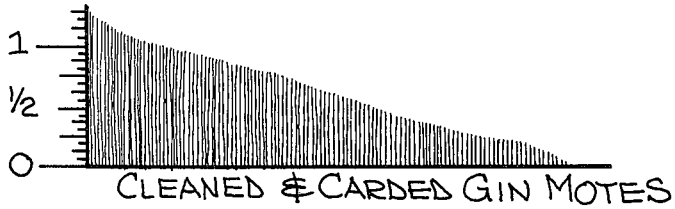
FIG. 2 is a staple fiber array showing the length distribution of the fibers contained in gin motes after cleaning and carding.

The combing operation is the most important step in processing gin motes to reclaim the spinnable cotton fibers contained therein. The cotton fibers contained in the gin motes range in length from the normal cotton staple length of the cotton processed at the gin (e.g. about 1 inch to 1 ¼ inches) to short non-spinnable dust-like fibers or linters. As illustrated in FIG. 2, the gin motes, after cleaning and carding, contain a large number of long fibers of spinnable length, but also contain a substantial proportion of short non-spinnable fibers. The coefficient of variation (CV) in fiber length of cleaned and carded gin motes may normally range from about 45% to about 60%. By way of comparison, the coefficient of variation (CV) for normal cotton is usually about 30% to 32%. Cotton fiber of a high CV containing a considerable amount of short fiber spins into uneven yarn. This type of stock is uncontrollable both in ring spinning and in preparatory processing such as drawing for ring or open-end spinning.

The term coefficient of variation (CV) as employed herein, is a conventional and well-recognized parameter expressing the variation in fiber length of the fibers in a given sample. The CV of a sample is determined by sorting the fibers of the sample according to length, measuring the amount (usually by weight) of the fibers of various lengths, and calculating the means fiber length and the standard deviation. The coefficient of variation (CV) is then determined by the following formula:

$$CV = \frac{\text{Standard Deviation}}{\text{Mean}} \times 100\%$$

Figure 3:
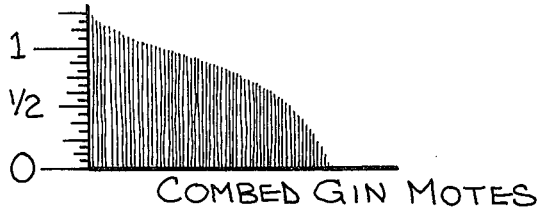
FIG. 3 is a staple fiber array showing the length distribution of the reclaimed combed fibers from gin motes processed in accordance with this invention.
Figure 4:
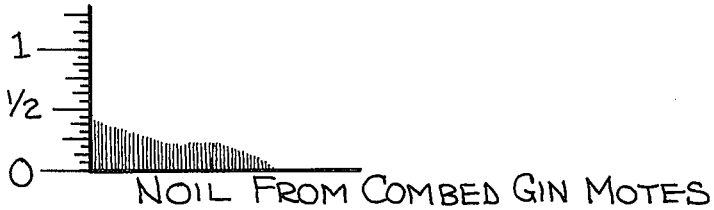
FIG. 4 is a staple fiber array showing the fiber length distribution of the comber noil from processing gin motes in accordance with this invention.

The combing operation serves to remove a substantial portion of the shorter length non-spinnable fibers and thereby to reduce the CV of the fibers to an acceptable range. Thus, as illustrated in FIG. 3, it will be seen that in the combed gin motes, most of the shorter fibers have been removed and remaining are a large proportion of longer spinnable fibers. Referring to FIG. 4, it will be seen that the comber noil fiber array from combing gin motes consists almost entirely of extremely short non-spinnable fibers. Upon visual inspection of this comber noil, hardly any recognizable spinnable fiber is found, with the noil consisting almost solely of fine pepper trash and extremely short fibers. In contrast thereto, the comber noil from combing conventional cotton contains a useful proportion of spinnable long fiber together with the short fiber, and thus has commercial value for some products such as low quality yarns, etc.

Any conventional cotton combing machine may be employed for the combing operation. However, most acceptable results have been achieved by employing combers equipped with improved comber half-laps having a series of closely spaced saw teeth rather than with conventional combing needles and needle bars. The saw-teeth-equipped comber half-lap of this type, which is somewhat similar to a licker-in, has been found to operate much more effectively than a conventional needle equipped half-lap, and without loading up with short fibers and trash. The commercially available NITTO UNICOMB (UNICOMB is a trademark) is a suitable saw-tooth-type half-lap of the type described.

It should be understood that combing machines were designed and intended for processing relatively clean long staple cotton intended for spinning into quality yarns of relatively fine counts, and have not heretofore been recognized as useful for processing gin motes with the large proportion of trash contained therein. The entirely different character of the comber noil from combing gin motes, as compared to conventional comber noil, reveals that the comber serves a different function when processing gin motes than when combing conventional cotton.

The actual CV achieved following combing may be varied as desired depending upon the intended end use of the reclaimed fibers, whether they are to be blended with other conventional fibers, and the type of spinning to be employed. In any event, however, a substantial reduction in CV is accomplished by the combing operation, which CV reduction may be controlled by adjustment of the combing machine to remove a predetermined amount of short fibers. By way of example, for obtaining acceptable CV fiber from gin motes of normal quality, the comber might be set to extract 15% to 20% by weight of noil.

The processing of the fibers after combing may vary depending upon the intended end use. For example, the combed stock may bypass the coiler and be directed to a bale press for forming bales of the reclaimed spinnable fibers. This baled cotton fiber would have high commercial value both for open-end and ring spinning mills, including mills blending various kinds of fibers with the reclaimed cotton. Normally in such mills, the blending would be done at the opening room.

Alternatively, the combed sliver may be processed directly through one or more additional drafting operations and then either to open-end spinning or through roving and to ring spinning.

Because of the extremely fragile nature of the combed sliver, drawing after combing should be done on draw frames equipped with power creels and preferably also with fluted calender rolls and/or fluted metallic top rolls. Evener type drawing may also be employed after combing. Also, the drawing after combing may, if desired, include blending the slivers of reclaimed fibers with slivers of other fibers, such as slivers of other reclaimed fibers or slivers of other conventional natural or synthetic fibers.

When spinning on open-end spinning machines, the parallelization of the fibers resulting from combing is highly advantageous in helping to eliminate or reduce the occurrence of hooked fibers. It is well known that hooked fibers are a serious problem in open-end spinning and contribute significantly to reduced yarn quality and strength. Reclaimed gin mote fibers pursuant to this invention are particularly well suited for spinning into yarns by the open-end method, since open-end spinning machines are somewhat more tolerant to fiber length variation than ring spinning.

As is also illustrated in FIG. 1, the combed reclaimed fibers after drawing may be conventionally processed on a roving frame and thereafter spun into yarns by ring spinning.

The cost savings which may be achieved in accordance with this invention should be readily apparent when considering the relative cost of gin motes as compared to conventional cotton. For example, with cotton selling in the range of about $.40 to $.50 per pound, uncleaned gin motes can be purchased for approximately $.04 to $.15 per pound and cleaned gin motes can be purchased for approximately $.15 to $.22 per pound. Considering that the yield of spinnable cotton fibers obtained per pound of uncleaned gin motes processed may range from 40% to 60%, depending upon the quality of the gin motes, it will be readily seen that the cost per pound of the reclaimed gin mote fibers is considerably less than the cost per pound of conventional cotton fibers, for example 50% or less.

It has been determined that gin motes derived from longer staple cotton were suitable for making a range of sizes from the lowest cotton counts up to 30 count. It is believed feasible that with further refinements and with proper control, cotton yarns up to 40 count or higher can be obtained. It has also been determined, when considering blending of the reclaimed gin motes with other fibers such as synthetics, that yarn counts up to 40 and higher can be obtained.

It is thus apparent that this invention lends itself for utilizing reclaimed gin mote fibers in a wide range of yarn sizes.

In the drawings, and specification there has been set forth a preferred embodiment of the invention, and although specific terms are employed, they are used in a generic and descriptive sense only and not for purposes of limitation.

That which is claimed is:

1. A method of reclaiming from relatively inexpensive gin motes the usable but normally waste cotton fibers contained therein and spinning a reduced cost yarn therefrom, said method comprising providing a supply of gin motes containing about 35% to 50% of trash with cotton fibers of a high coefficient of variation in fiber length unsuitable for being spun into yarns, directing the gin motes through a cleaning line and removing a substantial portion of the trash contained therein, processing the thus cleaned gin motes through at least one carding operation to provide a coefficient of variation in fiber length of about 45% to about 60% and thereafter through at least one drafting operation while removing further amounts of trash from the cotton fibers of the gin motes, advancing the thus cleaned, carded, and drafted cotton fibers of the gin motes through a combing machine and combing the same while removing additional trash and short non-spinnable fibers as comber noil and while reducing the coefficient of variation in fiber length to about 30% to 32% level suitable for subsequent processing into yarns, and thereafter spinning the thus reclaimed fibers to form a twisted yarn.

2. A method according to claim 1 wherein the spinning of the reclaimed fibers to form a twisted yarn therefrom comprises directing the reclaimed fibers through an open-end spinning machine.

3. A method according to claim 1 wherein the spinning of the reclaimed fibers to form a twisted yarn therefrom comprises directing the reclaimed fibers through a ring spinning machine.

4. A method of reclaiming from relatively inexpensive gin motes the usable but normally waste cotton fibers contained therein for subsequently spinning a reduced cost yarn therefrom, said method comprising providing a supply of gin motes containing about 35% to 50% of trash with cotton fibers of a high coefficient of variation in fiber length unsuitable for being spun into yarns, directing the gin motes through a cleaning line and removing a substantial portion of the trash contained therein, processing the thus cleaned gin motes through at least one carding operation to provide a coefficient of variation in fiber length of about 45% to about 60% and thereafter through at least one drafting operation while removing further amounts of trash from the cotton fibers of the gin motes, and advancing the thus cleaned, carded, and drafted cotton fibers of the gin motes through a combing machine and combing the same while removing additional trash and short non-spinnable fibers as comber noil and while reducing the coefficient of variation in fiber length to about 30% to 32% level suitable for subsequent processing into yarns.

* * * * *